US010206451B2

(12) United States Patent
Bird et al.

(10) Patent No.: US 10,206,451 B2
(45) Date of Patent: Feb. 19, 2019

(54) CYCLING SHOE

(75) Inventors: Carl Darius Bird, Aptos, CA (US); Robert A. L. Cook, Aptos, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 989 days.

(21) Appl. No.: 13/543,677

(22) Filed: Jul. 6, 2012

(65) Prior Publication Data

US 2014/0007463 A1 Jan. 9, 2014

(51) Int. Cl.
*A43B 5/14* (2006.01)
*A43B 13/12* (2006.01)

(52) U.S. Cl.
CPC ..... *A43B 5/14* (2013.01); *A43B 13/12* (2013.01)

(58) Field of Classification Search
CPC ..... A43B 5/14; A43B 13/12; A43B 13/186; A43B 13/187
USPC ..... 36/131, 103, 76 R, 72 A, 59 C
See application file for complete search history.

(56) References Cited

U.S. PATENT DOCUMENTS

| | | | | |
|---|---|---|---|---|
| 4,316,334 | A | 2/1982 | Hunt | |
| 4,547,979 | A | 10/1985 | Harada et al. | |
| 4,825,565 | A * | 5/1989 | Bigolin | 36/131 |
| 5,406,723 | A * | 4/1995 | Okajima | 36/131 |
| 5,446,977 | A * | 9/1995 | Nagano et al. | 36/131 |
| 5,836,094 | A * | 11/1998 | Figel | 36/131 |
| 5,924,220 | A * | 7/1999 | Ueda et al. | 36/131 |
| 5,943,795 | A * | 8/1999 | Ueda et al. | 36/131 |
| 6,018,889 | A * | 2/2000 | Friton | 36/28 |
| 6,055,746 | A | 5/2000 | Lyden et al. | |
| 6,108,943 | A | 8/2000 | Hudson et al. | |
| 6,260,291 | B1 * | 7/2001 | Farys | 36/131 |
| 6,286,232 | B1 | 11/2001 | Snyder et al. | |
| 6,568,102 | B1 | 5/2003 | Healy et al. | |
| 6,966,131 | B2 | 11/2005 | McCracken et al. | |
| 7,191,550 | B2 * | 3/2007 | Baek | 36/113 |
| 7,882,648 | B2 * | 2/2011 | Langvin | 36/59 R |
| 8,171,655 | B2 * | 5/2012 | Morgan | 36/18 |
| 8,567,095 | B2 * | 10/2013 | Ellis | 36/29 |

(Continued)

FOREIGN PATENT DOCUMENTS

| | | |
|---|---|---|
| EP | 0795280 A2 | 9/1997 |
| EP | 0741529 B1 | 10/2001 |

(Continued)

OTHER PUBLICATIONS

Combined Search and Examination Report; dated: Jan. 29, 2015; 2 pages.

*Primary Examiner* — Megan E Lynch
(74) *Attorney, Agent, or Firm* — Knobbe, Martens, Olson & Bear, LLP

(57) ABSTRACT

A clipless cycling shoe having an upper and a base plate. The base plate has a medial portion, a lateral portion and a medial sidewall. The medial portion has a rigid support structure having a top portion and a bottom portion, a cavity is formed between the top portion and bottom portion, wherein the cavity is filled with a core material. The lateral portion has a lateral plate. The medial sidewall wrap is adjacent the medial portion and extends outward and upward relative to the base plate and the medial sidewall wrap extends a portion of the length of the base plate. The medial portion is desirably thicker than the lateral portion.

19 Claims, 6 Drawing Sheets

(56) References Cited

U.S. PATENT DOCUMENTS

| | | | | |
|---|---|---|---|---|
| 2001/0022041 | A1* | 9/2001 | Gebhard | 36/131 |
| 2005/0278980 | A1* | 12/2005 | Berend et al. | 36/103 |
| 2006/0059724 | A1* | 3/2006 | Garneau | 36/131 |
| 2007/0017127 | A1* | 1/2007 | Chao et al. | 36/131 |
| 2007/0113428 | A1* | 5/2007 | Jau et al. | 36/131 |
| 2008/0276496 | A1* | 11/2008 | Kerns et al. | 36/131 |
| 2008/0295362 | A1* | 12/2008 | White | 36/103 |
| 2009/0193682 | A1* | 8/2009 | Rosenbaum | 36/88 |
| 2009/0199432 | A1* | 8/2009 | Park | 36/88 |
| 2010/0199523 | A1* | 8/2010 | Mayden et al. | 36/103 |
| 2011/0061264 | A1* | 3/2011 | Solymosi et al. | 36/88 |
| 2011/0107622 | A1* | 5/2011 | Schwirian | 36/30 A |
| 2011/0302809 | A1* | 12/2011 | Kim | 36/103 |
| 2012/0227287 | A1* | 9/2012 | Czan | 36/131 |
| 2013/0019505 | A1* | 1/2013 | Borel et al. | 36/103 |

FOREIGN PATENT DOCUMENTS

| | | | |
|---|---|---|---|
| EP | 1685772 | A1 | 8/2006 |
| JP | 2008307199 | A | 12/2008 |

* cited by examiner

CYCLING SHOE

BACKGROUND

Field of the Invention

This disclosure relates generally to the field of cycling footwear, more particularly to a cycling shoe.

SUMMARY

There are numerous types of cycling shoes which vary in weight, fit and comfort.

One aspect of one embodiment of the invention is the recognition that the stiffness of the cycling shoe is one of the factors that determine the amount of energy transferred from a rider to the bike. By making the shoe stiffer, the amount of energy transferred from the rider to the bike during the pedal stroke can be increased. One of the ways to increase the stiffness of the cycling shoe is to increase the stiffness of the base plate.

Another aspect of one embodiment of the invention is that the energy transfer is influenced not only by the amount of stiffness of the shoe, but also the area in which stiffness is increased. Specifically, in one embodiment the cycling shoe provides strength and stiffness where the cycling shoe is actually applying pressure during a pedal stroke. One aspect of the invention is the recognition that during a pedal stroke the most pressure is applied by the first metatarsal, the big toe, and the heel.

In one embodiment, a clipless cycling shoe has an upper and a base plate. The base plate includes a medial portion, a lateral portion, and a medial sidewall. The medial portion has a rigid support structure having a top portion and a bottom portion, a cavity is formed between the top portion and bottom portion, wherein the cavity is filled with a core material. The lateral portion has a lateral plate. The medial sidewall adjacent the medial portion that extends upward from the medial portion, the medial sidewall extends longitudinally along a portion of the length of the base plate. The medial portion is thicker than the lateral portion.

In other embodiments the core material is a polyurethane foam. The bottom portion can be thicker than the top portion of the support structure. The medial portion can be wider than the lateral portion. The lateral plate can have a uniform thickness. The base plate can have an orifice positioned in a toe section of the lateral portion. The upper can be flexible. The base plate can be carbon fiber. The base plate can be a noncompressible material.

In an alternate embodiment, a clipless cycling shoe has an upper and a base plate. A width of the base plate divided between a lateral portion and a medial portion. The medial portion of the base plate has a rigid support structure has a top portion and a bottom portion, a cavity is formed between the top portion and the bottom portion, and a core material substantially fills the cavity. The lateral portion has a lateral rigid plate. The base plate also has a phalanges section. At the phalanges section, a width of the medial portion is at least the same size or greater than a width of the lateral portion and a thickness of the medial portion is at least 1.75 times greater that a thickness of the medial portion.

In another embodiment at a metatarsal section of the base plate, a width of the medial portion is at least three times greater than a width of the lateral portion and a thickness of the medial portion is at least 2 times greater that a thickness of the medial portion.

In another embodiment at an upper tarsal section of the base plate, a width of the medial portion is at least 1.5 times greater than a width of the lateral portion and a thickness of the medial portion is at least 2 times greater that a thickness of the medial portion.

In another embodiment at a lower tarsal section of the base plate, a width of the medial portion is at least the same size or greater than a width of the lateral portion and a thickness of the medial portion is at least 2.5 times greater that a thickness of the medial portion.

In some embodiments the base plate further comprises a medial sidewall.

DETAILED DESCRIPTION

Figure 1:
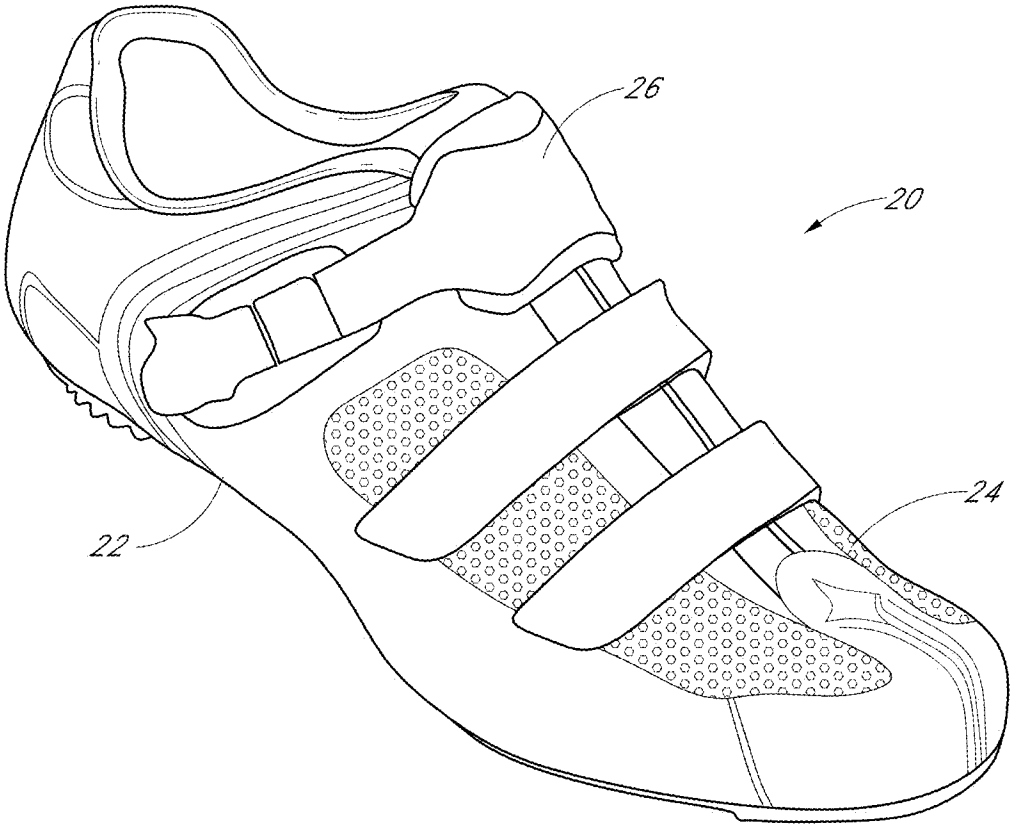
FIG. 1 is a perspective view of a cycling shoe

FIG. 1 illustrates an embodiment of a clipless cycling shoe 20. The cycling shoe 20 has a sole or base plate 22, an upper 24, and a closure system 26 on the topside of the upper 24. The upper 24 can be formed from nylon, synthetic leather, leather, or other material. The plate 22 can be formed from nylon, composite plates, carbon fiber, other noncompressible materials, or a combination of materials. The closure system 26 can be can have straps, a strap with a buckle or ratcheting mechanism, dial closure mechanism, or other closure mechanisms. The cycling shoe can have an insole (not shown).

Clipless cycling shoes have generally been designed with a symmetrical focus across the base plate or sole. The shoes have generally been designed to have consistent stiffness and rigidity across the medial side and lateral side. To do this, the structure of the shoe on the medial side has been generally symmetric with the structure of the shoe on lateral side. This symmetric design generally yields consistent stiffness and rigidity across the base plate.

The cycling shoe can be designed to focus the weight and strength where the pressure is actually being applied during a pedal stroke. During a pedal stroke the most pressure is applied towards the medial side of the plate, more specifically to the first metatarsal, the big toe, and the heel sections of the base plate. The geometry and structure of the base plate can be reinforced in the areas where the most pressure is applied in order to increase the stiffness, reduce the weight, and increase the fit and comfort of the shoe.

A reinforced medial side with a rigid support structure can increase the stiffness of the shoe and reduce the weight. By focusing more material and increasing the stiffness of the structure on the medial side, the base plate can have a higher stiffness on the portions of the base plate where pressure is applied. A base plate that has higher stiffness and rigidity where pressure is applied yields less flex thereby transferring more power directly from the cyclist's leg and foot to the pedal and the bike. Further by focusing the material on the medial portion and having less material on the lateral portion, the overall weight of the shoe can be reduced even though the effective stiffness is increased.

The stiffness of the base plate can be increased by having sidewalls on the medial and lateral sides of the plate wrap up around the foot and create a "bathtub" style construction. This can increase stiffness; however this bathtub design can be limiting to the fit and comfort of the cyclist's foot. The tall wrapping edges on both sides of the base plate can cause a rigid and restrictive fit that does not accommodate variations in foot shape. Similarly, rigid sidewalls on both sides of the base plate can make it difficult to accommodate different sized feet. For example, wider feet are constrained and restricted by the rigid sides, which can make the shoe uncomfortable and can restrict the flow of blood to the feet during long rides. Feet that are too narrow can shift within the rigid soles of the shoe during cycling because the shoe closure mechanism does not adequately adjust the sizing of the rigid sidewalls.

A rigid sidewall or wrap on the medial side and a substantially flat lateral side can increase the stiffness of the base plate and provide improved fit and comfort for the cyclist's foot. The medial side of the foot is supported by the rigid sidewall and the flexible upper conforms to the lateral side of the foot. The flexible upper provides support and can be adjusted by appropriately accommodate different sized feet. The closure mechanism can be used to adjust the flexible upper to appropriately secure the foot within the shoe. A wider foot can extend off the lateral side of the base plate and be held in place by the upper. A narrower foot can be substantially secured into place by the closure mechanism of the upper.

Figure 4:
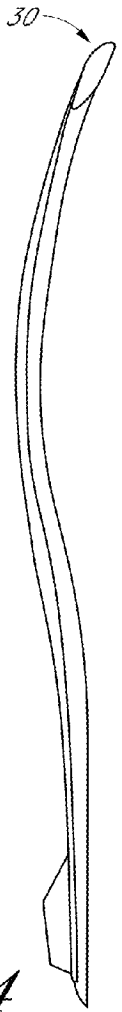
FIG. 4 is a view of the lateral side of the base plate from FIG. 2.
Figure 2:
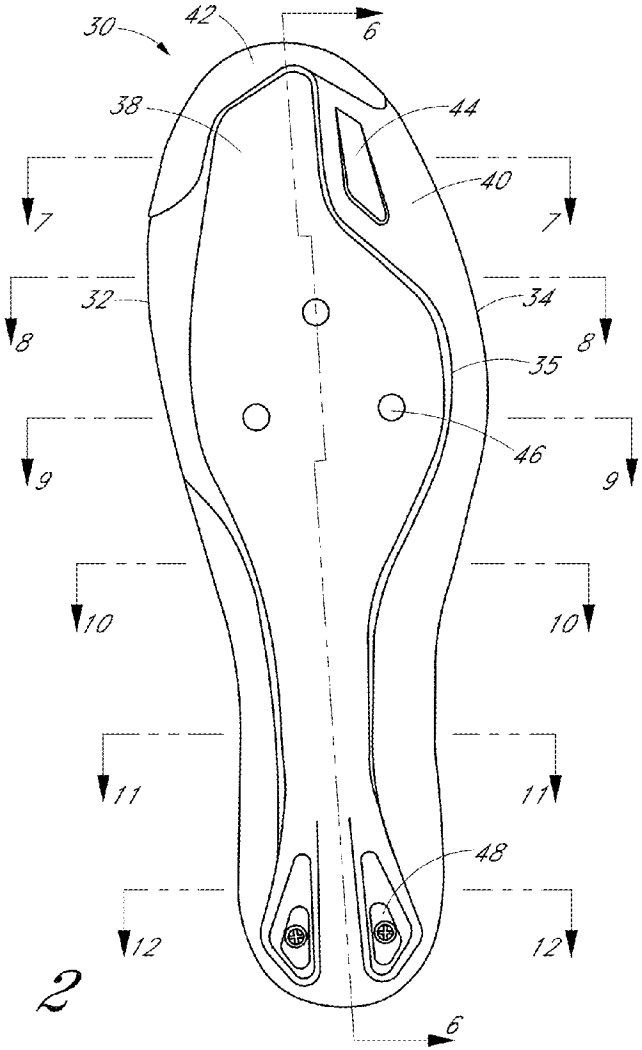
FIG. 2 is a bottom view of an embodiment of a base plate of a cycling shoe.
Figure 3:
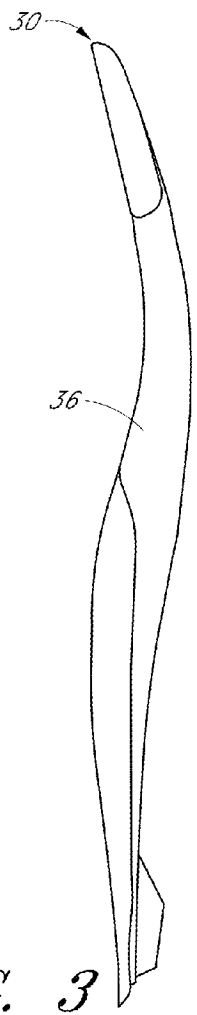
FIG. 3 is a view of the medial side of the base plate from FIG. 2.

FIGS. 2 through 5 illustrate views of an embodiment of a sole or base plate 30 for a cycling shoe with a reinforced medial side. In this embodiment the base plate 30 includes an orifice 44, a skid plate 42, a plurality of cleat mounting holes 46, and heel pads 48. The base plate 30 has a top surface, a bottom surface, a medial side 32 and a lateral side 34. The medial side 32 is the arch side or inner side of the plate 30. The lateral side 34 is the outer side of the plate 30. FIG. 3 is a side view of the medial side of the base plate. FIG. 4 is a view of the lateral side of the base plate. The base plate 30 can be divided up longitudinally into sections based on the portion of the foot that contacts the base plate 30. The base plate can have a phalanges or toes section, a metatarsal section, and a tarsal or heel section. The top surface of the base plate 30 is substantially smooth. The middle of the top surface is desirably substantially flat and rotates slightly upwards on the lateral edge 34. On the medial side 32 the base plate has a sidewall 36 that extends upwards and is configured to wrap around the side of the cyclist's foot. The curvature of the base plate 30 is desirably configured to match the curvature of the foot. The base plate 30 can be formed from a rigid material such as nylon, composite plates, carbon fiber, other noncompressible materials, or a combination of materials. The base plate 30 can be manufactured as a single structure. The base plate desirably has a reinforced medial portion 38 and a lateral portion 40. The outer edge of the medial portion is shown by line 35.

In this embodiment, the base plate 30 has a skid plate 42 positioned substantially around the top part of the base plate 30. The skid plate 42 can be formed from a rubberized coating, thermoplastic polyurethane, or other suitable material. The skid plate 42 is designed to help protect the toe section of the base plate 46 from being damaged during normal usage. The base plate also has two heel pads 48. The pads 48 can be removable. The pads 48 are configured to protect the base plate of the shoe when the cyclist is walking. In this embodiment the bottom side of the base plate 30 is substantially smooth and does not have tread or other material for traction.

The orifice 44 desirably extends through the base plate. The orifice can provide airflow to the interior of the shoe to cool the foot of the cyclist while riding. In some embodiments the orifice 44 can have a mesh coating that covers the orifice. An insole can also cover the orifice 44. The orifice 44 is desirably sized and shaped to not substantially affect the effective stiffness and rigidity of the shoe that is required for pedaling.

The plurality of cleat mounting holes 46 is desirably positioned in the middle or metatarsal portion of the shoe. There are desirably three holes 46 positioned in a triangular cleat mounting pattern. The three cleat mounting holes 46 are desirably configured in a pattern that fits a plurality of different cleats and clipless pedals.

FIGS. 6 through 12 are cross sections of the base plate 30 along the lines referenced on FIG. 2. The general structure of the base plate 30 is described in reference to FIG. 8. The base plate 30 can be generally divided up into three portions, the sidewall 36, the medial portion 38, and the lateral portion 40.

The medial portion 38 of the base plate 30 desirably has a medial support structure 50. The support structure 50 desirably has a top portion 52 and a bottom portion 54. The bottom portion 54 extends or angles upward toward the top portion 52. A cavity 56 is formed in the support structure 50 between the top portion 52 and the bottom portion 54. In some embodiments the medial support structure 50 is solid does not have a cavity 56. The support structure 50 is formed from a rigid material. A filler or core material 57 can fill the cavity 56. In some embodiments, a core material 57 can be used to increase the stiffness of the base plate 30. In some embodiments, the core material 57 can be a noncompressible lightweight material, such as polyurethane foam. The support structure has a medial side end 60 and a lateral side end 62. The bottom portion 54 ramps up to the top portion 52 on the medial side end. The side wall 36 extends upward from the medial side end of the support structure 50. The bottom portion 54 ramps up to the top portion 52 at the lateral side end. The lateral portion 40 extends outwards from the lateral side end of the support structure 50. The support structure 50 is configured to increase the rigidity and stiffness of the base plate 30. The thickness of the support structure 50 is desirably largest when at medial side end and decreases towards the lateral side end.

The lateral portion 40 is desirably a single plate having a top and bottom surface. The lateral portion desirably merges with the top portion 52 and the bottom portion 54 of the support structure 50. The lateral portion can have a uniform thickness and has the same curvature as the base plate. The bottom surface of the lateral portion desirably intersects with the lateral side end 62 of the medial portion structure 50.

The sidewall 36 portion curves generally upward relative to the medial and lateral portions 38, 40 of the base plate 30. The sidewall 36 desirably merges with the top portion 52 and the bottom portion 54 of the support structure 50 at the medial side end 60. The height and curvature of the sidewall 36 desirably varies along the length of the base plate 30. The height and profile of the sidewall 36 is illustrated in FIG. 3. The cross sections of the base plate 30 shown in FIGS. 7 through 11 illustrate the varying curvature and height of the sidewall 36. The structure and geometry of the sidewall are desirably configured to reinforce and stiffen the medial side of the base plate 30. The sidewall 36 is configured to wrap around the medial side of the shoe and the cyclist's foot.

Figure 7:
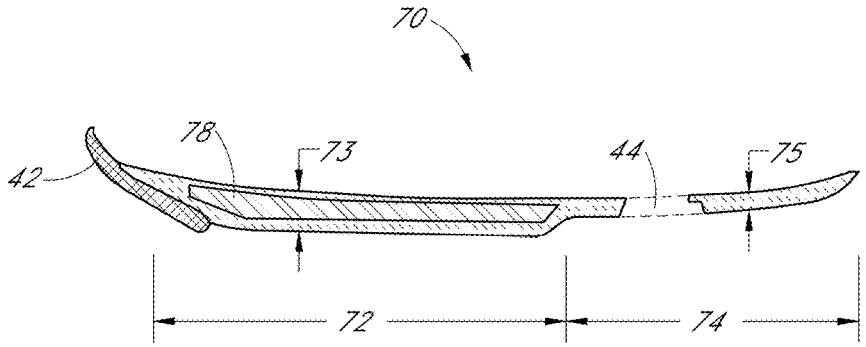
FIG. 7 is a cross section of the base plate from FIG. 2 taken along line 7-7.

The structural elements discussed with respect to the sidewall, medial, and lateral portions apply generally to the base plate 30. The widths and proportions of the medial portions and the lateral portions can vary along the length of the base plate 30. By way of example, FIG. 7 shows a cross section of the phalanges section 70, which has a medial portion 72 and a lateral portion 74. The medial portion 72 and the lateral portions 74 of the phalanges section 80 have different dimensions and different proportions than the medial portion 82 and the lateral portion 84 of the metatarsal section 80.

The base plate 30 is described herein as having different portions and/or structures, such as the medial, lateral, and sidewall portions. These conventions are used to describe the structure of the base plate and are not to be construed to limit the disclosure to a base plate having separate components with explicit structural boundaries. The medial, lateral, and sidewall portions can be formed and fabricated as a single structure.

Figure 6:
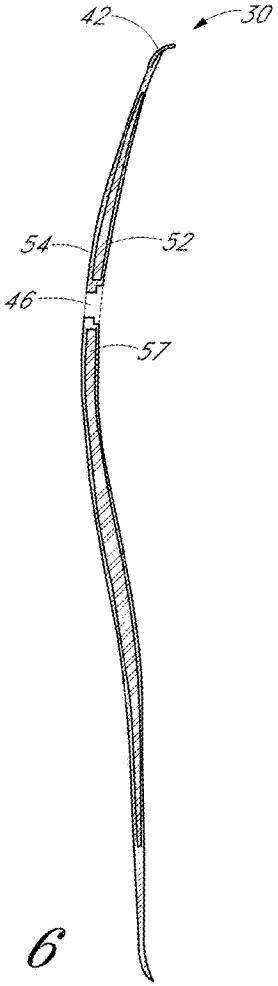
FIG. 6 is a cross section of the base plate from FIG. 2 taken along line 6-6.
Figure 5:
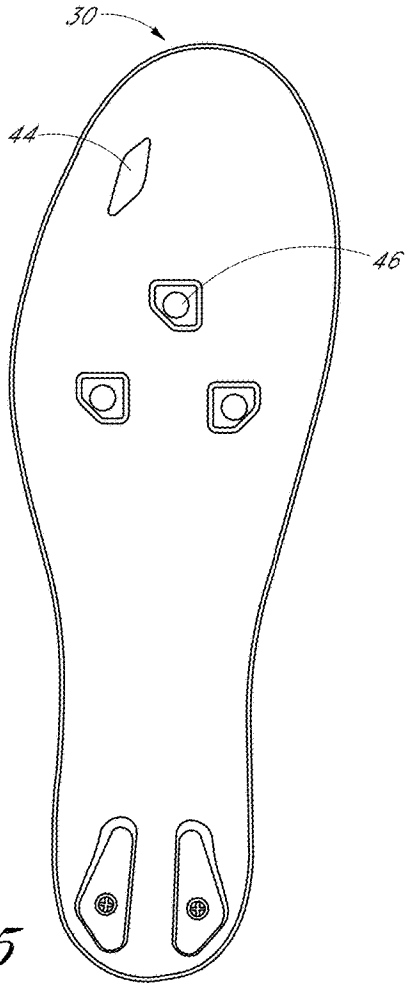
FIG. 5 is a top view of the base plate from FIG. 2.

FIG. 6 is a cross section along the approximate centerline of the base plate 30. The cross section start of the medial portion cavity 56 near the toe of the base plate 30 and the end of the cavity 56 near the heel section. In this embodiment, the top portion 52 of the support structure has a substantially uniform thickness and the bottom portion 54 has a substantially uniform thickness. In this embodiment the thickness of the bottom portion 54 is greater than the thickness of the top portion 52. In some embodiments the top and bottom portions 52, 54 can have the same thickness.

FIG. 7 is a cross section of the phalanges section 70 of the base plate 30. In the phalanges section 70, the medial portion 38 has a width 72 and a thickness 73. The thickness of the medial portion 73 is greatest at the medial side and decreases as it approaches the lateral side. The lateral portion 40 has a width 74 and a thickness 75. The orifice 44 is formed through the lateral portion 40 of the base plate. At the phalanges section, the width of the medial portion 72 can be the same size or greater than the width of the lateral portion 74. The thickness of the medial portion 73 can be at least 1.75 times greater than the thickness of the lateral portion 75. In one embodiment the medial portion has a width of 43 mm and a thickness of 3.45 mm, and the lateral side has a width of 26 mm and a thickness of 1.70 mm.

Figure 8:
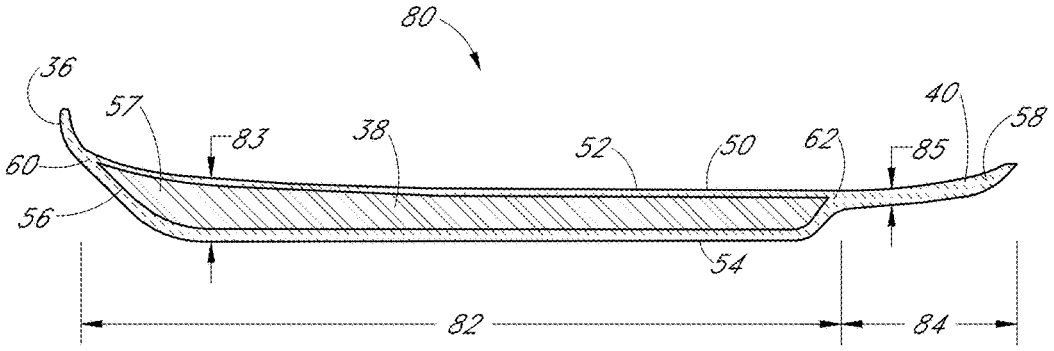
FIG. 8 is a cross section of the base plate from FIG. 2 taken along line 8-8.

FIG. 8 is a cross section of the metatarsal section 80 of the base plate 30. In the metatarsal section 80, the medial portion 38 has a width 82 and a thickness 83. The thickness of the medial portion 93 is greatest at the medial side and decreases as it approaches the lateral side. The lateral portion 40 has a width 84 and a thickness 85. The sidewall 36 curves upwards and outwards from the medial portion 38. At the metatarsal section 80, the width of the medial portion 82 can be at least three times greater than the width of the lateral portion 84. The thickness of the medial portion 83 can be at least two times greater than the thickness of the lateral portion 85. In one embodiment the medial portion has a width of 70 mm and a thickness that ranges from approximately 6.00 mm to 4.35 mm, and the lateral side has a width of 13 mm and a thickness of 1.70 mm.

Figure 9:
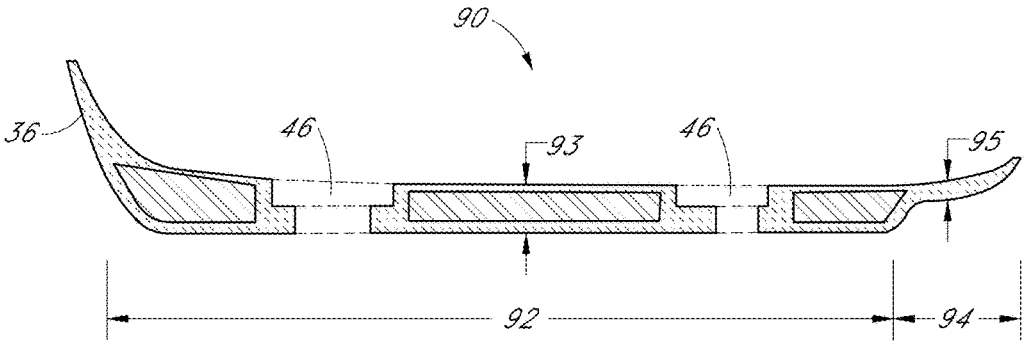
FIG. 9 is a cross section of the base plate from FIG. 2 taken along line 9-9.

FIG. 9 is a cross section of the cleat section 90 of the base plate 30. In the cleat section 90, the medial portion 38 has a width 92 and a thickness 93. The thickness of the medial portion 93 is greatest at the medial side and decreases as it approaches the lateral side. The lateral portion 40 has a width 94 and a thickness 95. The sidewall 36 curves upwards and outwards from the medial portion 38. The cleat holes 46 are formed in the medial portion 38. The medial portion cavity 56 is formed around the cleat holes 46 and has reinforced sidewalls between the cleat holes 46 and the cavity 56.

At the cleat section 90, the width of the medial portion 92 can be at least five times greater than the width of the lateral portion 94. The thickness of the medial portion 93 can be at least two times greater than the thickness of the lateral portion 95. In one embodiment the medial portion has a width of 73 mm and a thickness that ranges from approximately 6.00 mm to 4.35 mm, and the lateral side has a width of 11 mm and a thickness of 1.70 mm.

Figure 10:
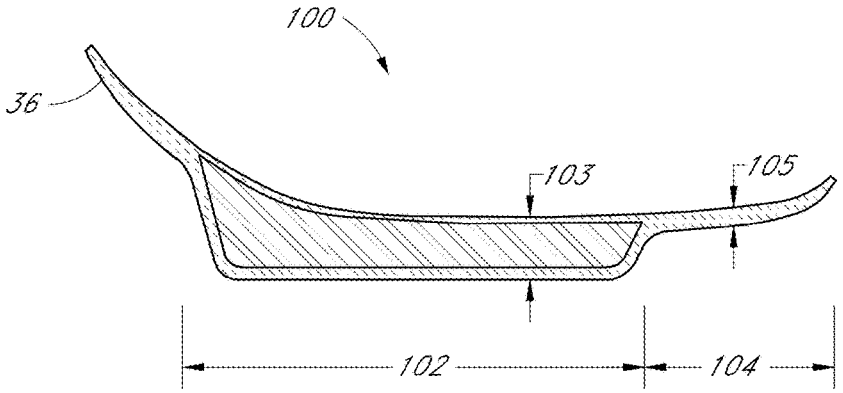
FIG. 10 is a cross section of the base plate from FIG. 2 taken along line 10-10.

FIG. 10 is a cross section of the upper tarsal section 100 of the base plate 30. In the upper tarsal section 100, the medial portion 38 has a width 102 and a thickness 103. The thickness of the medial portion 103 is greatest at the medial side and decreases as it approaches the lateral side. The lateral portion 40 has a width 104 and a thickness 105. The sidewall 36 curves upwards and outwards from the medial portion 38. At the upper tarsal section 100, the width of the medial portion 102 can be at least 1.5 times greater than the width of the lateral portion 104. The thickness of the medial portion 103 can be at least 2.5 times greater than the thickness of the lateral portion 105. In one embodiment the medial portion has a width of 39 mm and a thickness that ranges from approximately 10 mm to 13 mm, and the lateral side has a width of 19 mm and a thickness of 1.70 mm.

Figure 11:
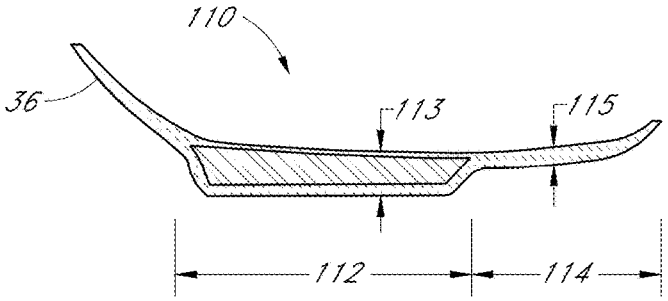
FIG. 11 is a cross section of the base plate from FIG. 2 taken along line 11-11.

FIG. 11 is a cross section of the lower tarsal section 110 of the base plate 30. In the lower tarsal section 110, the medial portion 38 has a width 112 and a thickness 113. The thickness of the medial portion 113 is greatest at the medial side and decreases as it approaches the lateral side. The lateral portion 40 has a width 114 and a thickness 115. The sidewall 36 curves upwards and outwards from the medial portion 38. At the lower tarsal section 110, the width of the medial portion 102 can be the same size or greater than the width of the lateral portion 104. The thickness of the medial portion 103 can be at least 2.5 times greater than the thickness of the lateral portion 105. In one embodiment the medial portion has a width of 25 mm and a thickness that ranges from approximately 7.5 mm to 5.5 mm, and the lateral side has a width of 18 mm and a thickness of 1.70 mm.

Different embodiments and different size cycling shoes can have different dimensions for the medial and lateral portions at the different sections, but the relative ratios between the medial and lateral portion can be substantially the same.

Figure 12:
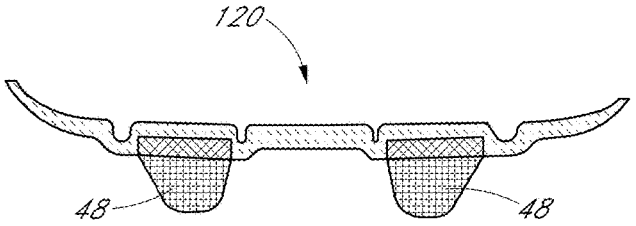
FIG. 12 is a cross section of the base plate from FIG. 2 taken along line 12-12.

FIG. 12 is a cross section of the heel section 120 of the base plate. The base plate 30 of the heel section 120 shows the pads 48. The base plate 30 is not divided between a medial and a lateral portion.

Figure 13:
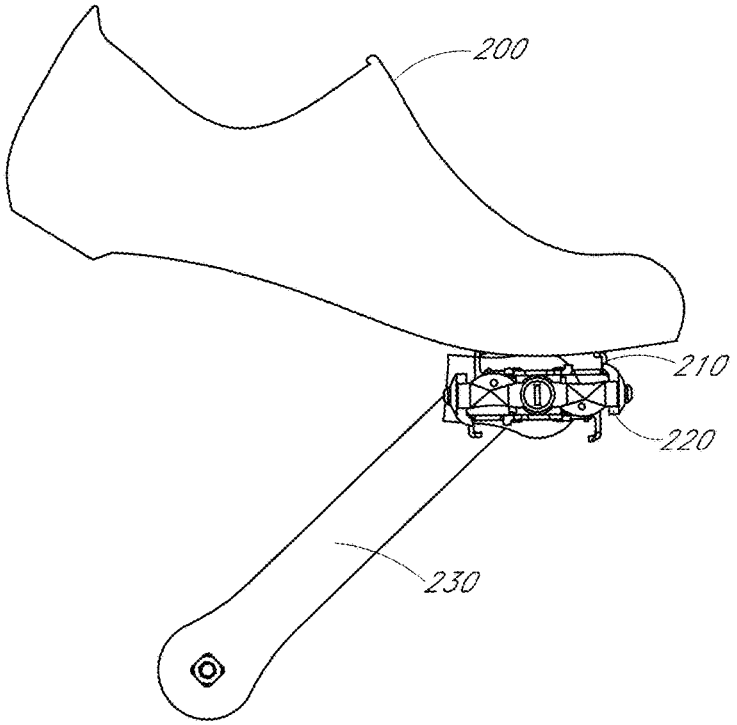
FIG. 13 is an illustration of a cycling shoe coupled to a pedal and crank arm.

FIG. 13 illustrates the coupling of a cycling shoe 200 to a pedal 220. The pedal 220 is securely coupled to a crank arm 230. Rotation of the crank arm by the pedal during a pedal stroke moves the bike. The cycling shoe 200 has a base plate, such as the base plate 30 discussed herein. The cleat plate 210 is desirably securely mounted to a cleat mounting portion of the base plate. The cleat plate 210 is configured to removably couple to the pedal 220. The cleat plate 210 can be inserted into and removed from the pedal 220 by the cyclist. The cleat plate 210 effectively couples the base plate of the cycling shoe 200 to the pedal 220 during the entire rotation of the pedal stroke.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A clipless cycling shoe comprising:

an upper; and a base plate comprising a medial sidewall, a medial portion, a lateral portion, and a lateral edge, the medial portion having a rigid support structure having a top portion, a bottom portion, a medial side end, and a lateral side end, wherein the top portion and bottom portion merge at the medial side end and at the lateral side end, a cavity is formed between the top portion, the bottom portion, the medial side end, and the lateral side end, wherein the cavity is filled with a core material, the medial portion extending from the lateral portion at the lateral side end to the medial side end, the lateral portion extending outward from the lateral side end of the medial portion to the lateral edge of the base plate, a medial sidewall adjacent the medial portion that extends upward from the medial portion, the medial sidewall extends longitudinally along the portion of the length of the base plate, the medial sidewall extending from the medial side end of the medial portion of the base plate; and wherein a top surface of the base plate is defined by the medial portion and the lateral portion, the top surface of the base plate extending from the medial side end of the medial portion to the lateral edge of the base plate, wherein the top surface is substantially flat, the portion of the top surface defined by the medial portion of the top surface is substantially flat and the portion of the top surface defined by the lateral portion is substantially flat with the exception of a portion of the top surface defined by the lateral edge of the lateral portion that rotates upward, and wherein the medial portion is thicker than the lateral portion.

2. The clipless cycling shoe of claim 1, wherein the core material is a polyurethane foam.

3. The clipless cycling shoe of claim 1, wherein the bottom portion is thicker than the top portion.

4. The clipless cycling shoe of claim 1, wherein the medial portion is wider than the lateral portion.

5. The clipless cycling shoe of claim 1, wherein an orifice is positioned in a toe section of the lateral portion.

6. The clipless cycling shoe of claim 1, wherein the upper is flexible.

7. The clipless cycling shoe of claim 1, wherein the base plate is carbon fiber.

8. The clipless cycling shoe of claim 1, wherein the base plate is a noncompressible material.

9. A clipless cycling shoe comprising:

an upper; and a base plate comprising a medial portion, a lateral portion, and a lateral edge, a width of the base plate divided between the lateral portion and the medial portion, the medial portion of the base plate has a rigid support structure having a top portion, a bottom portion, a medial side end, and a lateral side end, wherein the top portion and bottom portion merge at the medial side end and at the lateral side end, a cavity is formed between the top portion, the bottom portion, the medial side end, and the lateral side end, a core material substantially fills the cavity, the medial portion extending from the lateral portion at the lateral side end to the medial side end, and the lateral portion extending outward from the lateral side end of the medial portion to the lateral edge of the base plate, wherein a top surface of the base plate is defined by the medial portion and the lateral portion, the top surface of the base plate extending from the medial side end of the medial portion to the lateral edge of the base plate, wherein the top surface is substantially flat, the portion of the top surface defined by the medial portion of the top surface is substantially flat and the portion of the top surface defined by the lateral portion is substantially flat with the exception of a portion of the top surface defined by the lateral edge of the lateral portion that rotates upward.

10. The clipless cycling shoe of claim 9, wherein at a cross section of the base plate, a width of the medial portion relative to a width of the lateral portion is 3:1.

11. The clipless cycling shoe of claim 9, wherein at cross section of the base plate, a width of the medial portion relative to a width of the lateral portion is 1.5:1.

12. The clipless cycling shoe of claim 9, wherein at a cross section of the base plate, a width of the medial portion relative to a width of the lateral portion is 1:1.

13. The clipless cycling shoe of claim 9, wherein the base plate further comprises a medial sidewall.

14. The clipless cycling shoe of claim 9, wherein at a cross section of the base plate, a width of the medial portion relative to a width of the lateral portion is 5:1.

15. The clipless cycling shoe of claim 9, wherein at a cross section of the base plate, a thickness of the medial portion is at least 1.75 times greater than a thickness of the lateral portion.

16. A clipless cycling shoe comprising:

an upper;

a base plate comprising a medial portion, a lateral portion, and a lateral edge, the medial portion of the base plate has a rigid support structure having a top portion, a bottom portion, a medial side end, and a lateral side end, wherein the top portion and bottom portion merge at the medial side end and at the lateral side end, a cavity is formed between the top portion, the bottom portion, the medial side end, and the lateral side end, a core material substantially fills the cavity, the medial portion extending from the lateral portion at the lateral side end to the medial side end;

the lateral portion extending outward from the lateral side end of the medial portion to the lateral edge of the base plate; and a width of the base plate divided between the medial portion and the lateral portion, wherein at a first cross-section of the base plate a width of the medial portion relative to a width of the lateral portion is 3:1.

17. The clipless cycling shoe of claim 16, wherein at a second cross section of the base plate, a thickness of the medial portion is at least 1.75 times greater than a thickness of the lateral portion.

18. The clipless cycling shoe of claim 16, wherein at a second cross section of the base plate, a width of the medial portion relative to a width of the lateral portion is at least one of 1:1, 1:1.5, or 5:1.

19. The clipless cycling shoe of claim 16, wherein an orifice is positioned in the lateral portion.

* * * * *